US011612800B1

(12) United States Patent
Smith et al.

(10) Patent No.: US 11,612,800 B1
(45) Date of Patent: Mar. 28, 2023

(54) BALL-PROJECTING BATTING TEE

(71) Applicants: Travis Smith, Shelby, NC (US); Sheldon Smith, Shelby, NC (US)

(72) Inventors: Travis Smith, Shelby, NC (US); Sheldon Smith, Shelby, NC (US)

( * ) Notice: Subject to any disclaimer, the term of this patent is extended or adjusted under 35 U.S.C. 154(b) by 121 days.

(21) Appl. No.: 17/353,913

(22) Filed: Jun. 22, 2021

(51) Int. Cl.
*A63B 71/00* (2006.01)
*A63B 69/40* (2006.01)
*A63B 69/00* (2006.01)
*A63B 102/18* (2015.01)

(52) U.S. Cl.
CPC ..... *A63B 69/409* (2013.01); *A63B 69/0002* (2013.01); *A63B 2069/0008* (2013.01); *A63B 2069/401* (2013.01); *A63B 2102/18* (2015.10); *A63B 2225/093* (2013.01); *A63B 2225/50* (2013.01)

(58) Field of Classification Search
CPC ..... A63B 69/409; A63B 69/0002; A63B 2069/0008; A63B 2069/401; A63B 2225/093
USPC ..... 473/418
See application file for complete search history.

(56) References Cited

U.S. PATENT DOCUMENTS 3,612,027 A 10/1971 Makino
4,709,924 A 12/1987 Wilson
4,858,921 A * 8/1989 Eustice ..... A63B 69/0075 473/418
4,865,318 A 9/1989 Lehmann
5,160,131 A 11/1992 Saturnino
5,590,876 A 1/1997 Sejnowski
5,597,160 A 1/1997 Mims
D423,060 S 4/2000 Clark
6,719,649 B1 4/2004 Lin
7,294,071 B1 * 11/2007 Saumell ..... A63B 69/0053 473/418
7,846,045 B1 * 12/2010 Kendall ..... A63B 69/0075 473/418
7,874,942 B2 * 1/2011 Auzoux ..... A63B 69/409 473/417
9,114,297 B1 * 8/2015 Saumell ..... A63B 47/002 473/418
10,857,442 B2 * 12/2020 Kibbe ..... A63B 71/023 473/418
2002/0198068 A1 * 12/2002 Jordan ..... A63B 69/0002 473/418

FOREIGN PATENT DOCUMENTS

WO 2012139005 10/2012

* cited by examiner

*Primary Examiner* — Mitra Aryanpour
(74) *Attorney, Agent, or Firm* — Kyle A. Fletcher, Esq.

(57) ABSTRACT

The ball-projecting batting tee comprises a support base, a support column, and a remote control. The ball-projecting batting tee may be a batting practice aid that may be placed on top of home plate and may pneumatically project a ball upwards from the top of the support column to simulate a pitch. The ball-projecting batting tee may be adapted to project the ball upwards under the control of a coach using the remote control. As non-limiting examples, the ball may be a baseball or a whiffle ball. A directional cover located at the top of the support column may pivot to direct the ball towards first base or towards third base to simulate outside and inside pitches.

18 Claims, 4 Drawing Sheets

BALL-PROJECTING BATTING TEE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports practice equipment, more specifically, a ball-projecting batting tee.

SUMMARY OF INVENTION

The ball-projecting batting tee comprises a support base, a support column, and a remote control. The ball-projecting batting tee may be a batting practice aid that may be placed on top of home plate and may pneumatically project a ball upwards from the top of the support column to simulate a pitch. The ball-projecting batting tee may be adapted to project the ball upwards under the control of a coach using the remote control. As non-limiting examples, the ball may be a baseball or a whiffle ball. A directional cover located at the top of the support column may pivot to direct the ball towards first base or towards third base to simulate outside and inside pitches.

An object of the invention is to pneumatically project a ball upwards in front of a batter to simulate a pitch.

Another object of the invention is to enable a coach to initiate the upward projection of the ball remotely using a remote control.

A further object of the invention is to provide a directional cover that pivots to support the ball and to orient the direction of the simulated pitch.

Yet another object of the invention is to provide a support base with a bladder, a motor-driven compression plate to compress the bladder and pressurize the air within the bladder, and a valve to release the pressurized air from the bladder into a hollow column that support the ball.

These together with additional objects, features and advantages of the ball-projecting batting tee will be readily apparent to those of ordinary skill in the art upon reading the following detailed description of the presently preferred, but nonetheless illustrative, embodiments when taken in conjunction with the accompanying drawings.

In this respect, before explaining the current embodiments of the ball-projecting batting tee in detail, it is to be understood that the ball-projecting batting tee is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ball-projecting batting tee.

It is therefore important that the claims be regarded as including such equivalent construction insofar as they do not depart from the spirit and scope of the ball-projecting batting tee. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
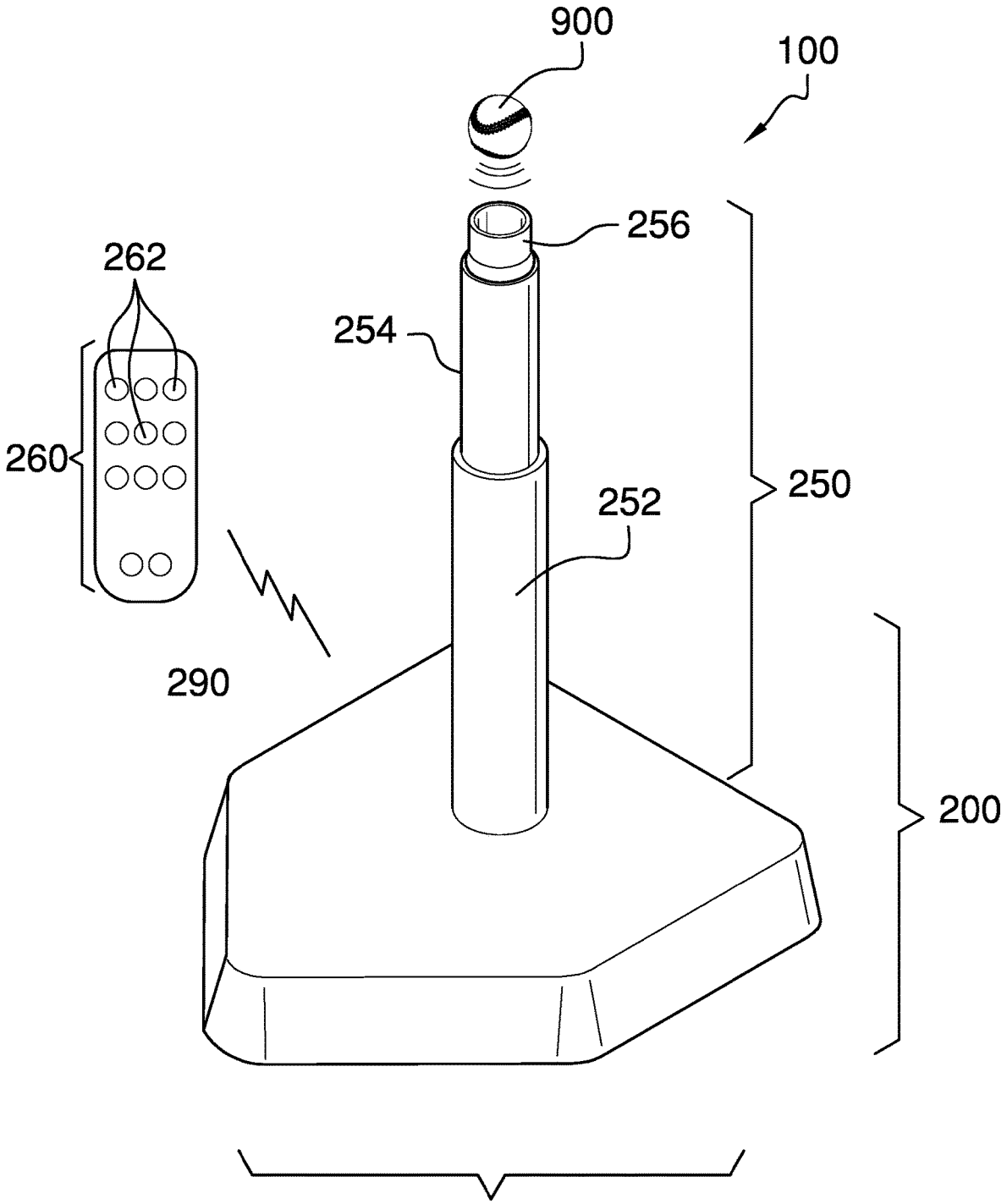
FIG. 1 is an isometric view of an embodiment of the disclosure.
Figure 2:
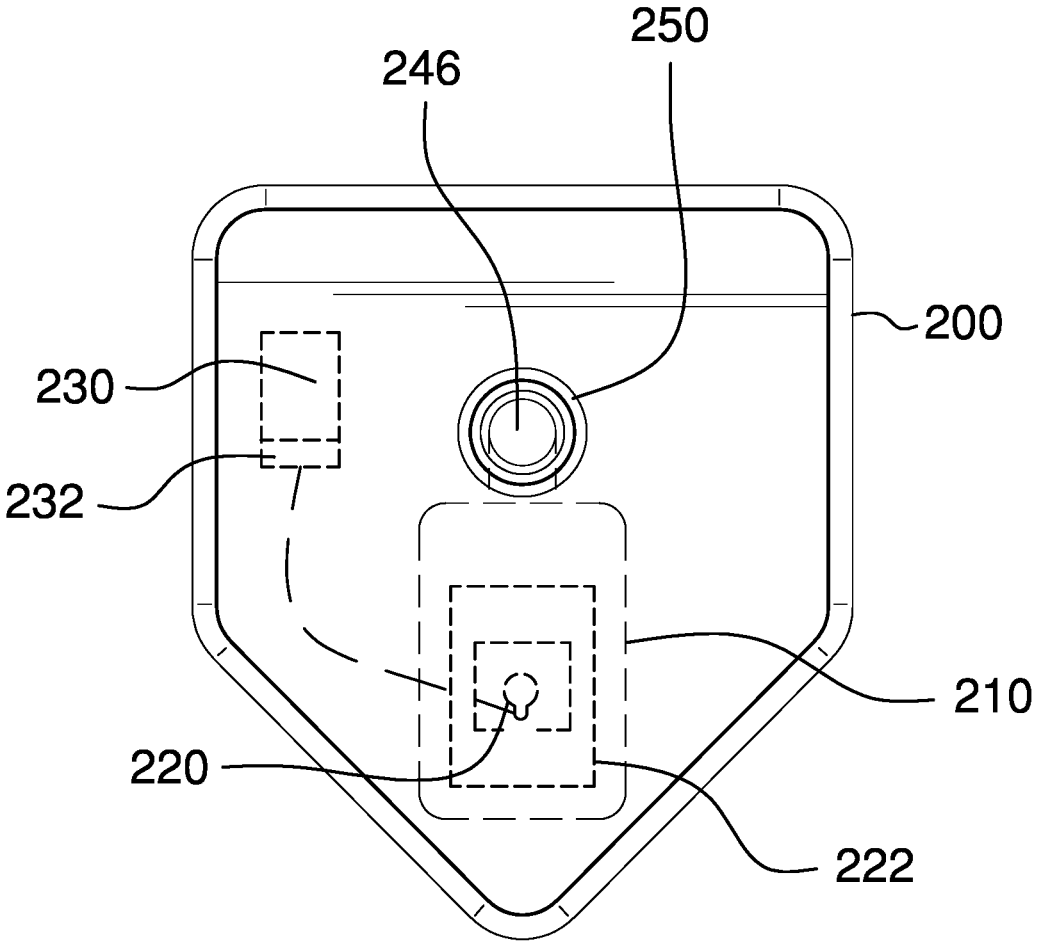
FIG. 2 is a top view of an embodiment of the disclosure.
Figure 3:
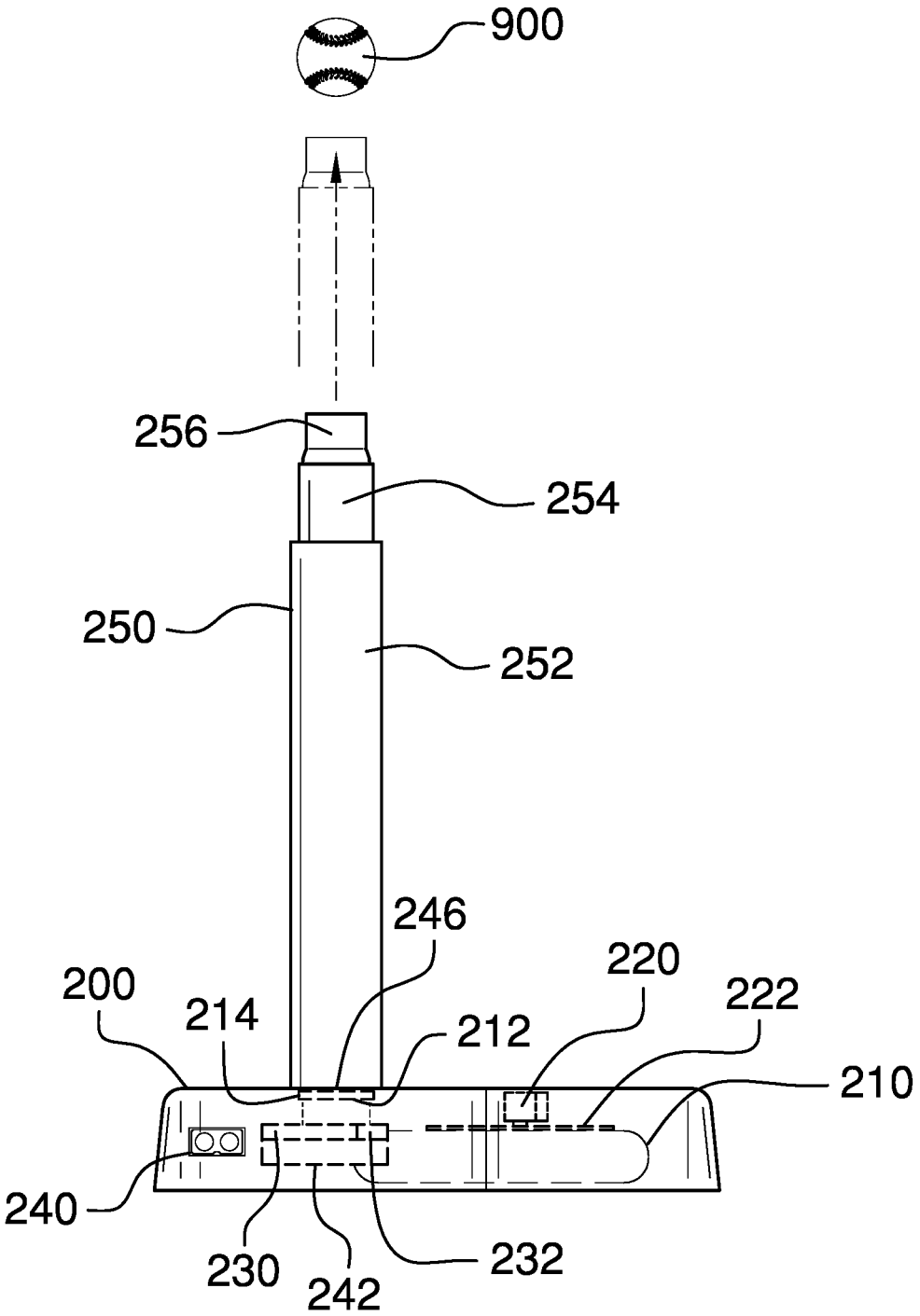
FIG. 3 is a side view of an embodiment of the disclosure.
Figure 4:
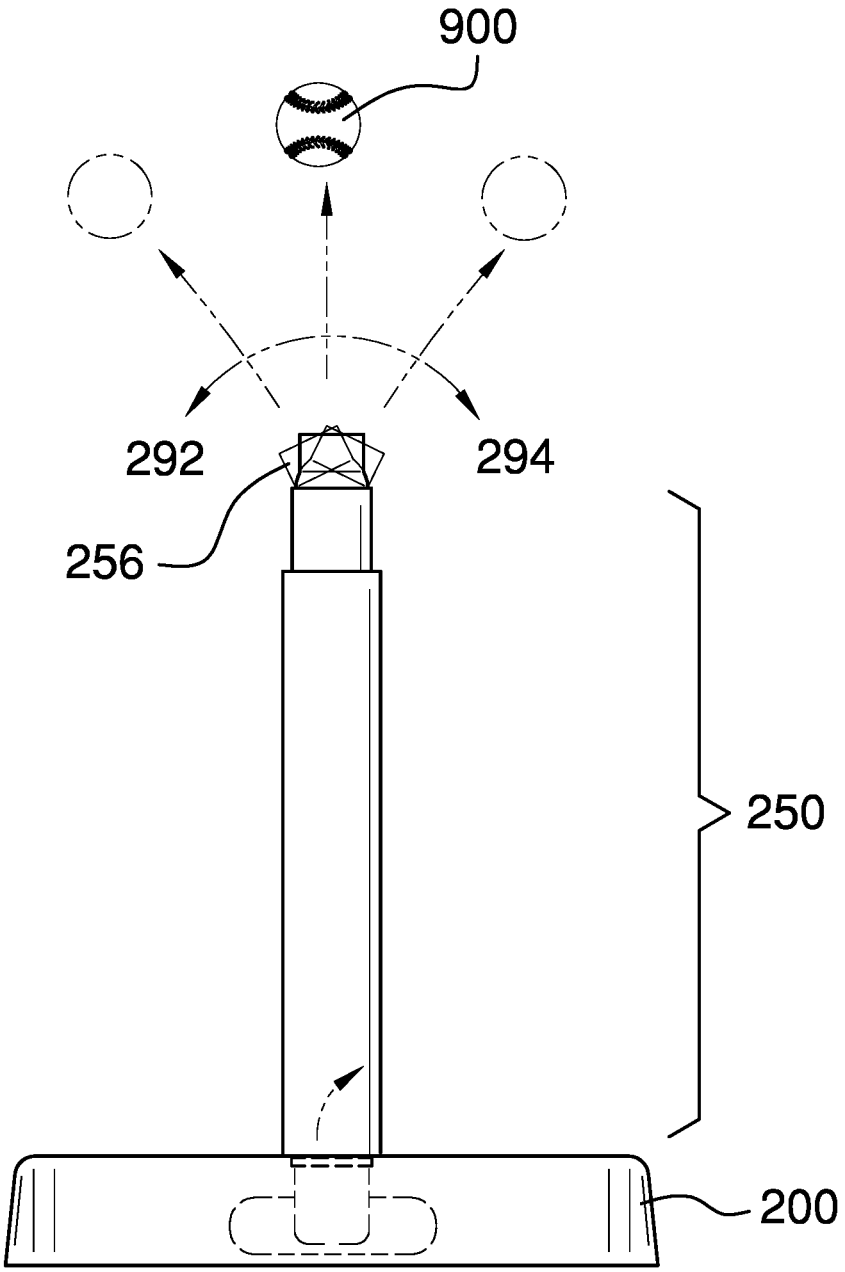
FIG. 4 is a rear view of an embodiment of the disclosure.

Detailed reference will now be made to a first potential embodiment of the disclosure, which is illustrated in FIGS. 1 through 4.

The ball-projecting batting tee 100 (hereinafter invention) comprises a support base 200, a support column 250, and a remote control 260. The invention 100 may be a batting practice aid that may be placed on top of home plate and may pneumatically project a ball 900 upwards from the top of the support column 250 to simulate a pitch. The invention 100 may be adapted to project the ball 900 upwards under the control of a coach using the remote control 260. As non-limiting examples, the ball 900 may be a baseball or a whiffle ball. A directional cover 256 located at the top of the support column 250 may pivot to direct the ball 900 towards first base 292 or towards third base 294.

The support base 200 may comprise a bladder 210, a motor 220, a compression plate 222, a valve 214, and a controller 230. The support base 200 may be a pentagonal shape when viewed from above in order to match the shape of the home plate. The support base 200 may be placed onto the home plate such that the edges of the support base 200 align with the edges of the home plate. The bottom of the support column 250 may couple to the center of the support base 200 such that the support column 250 rises vertically from the support base 200.

The bladder 210 may be a flexible, airtight sack for holding air. The bladder 210 may comprise a bladder aperture 212 which may be the only opening in the bladder 210. Air within the bladder 210 may be forced out of the bladder 210 via the bladder aperture 212 when the bladder 210 is compressed. Air outside of the bladder 210 may be drawn into the bladder 210 via the bladder aperture 212 when the bladder 210 is expanded. The bladder 210 may be compressed by pressure applied to the top of the bladder 210 by the compression plate 222. In some embodiments, the bladder 210 may be self-inflating, meaning that the bladder expands and fills with air when the bladder aperture 212 is open. As non-limiting examples, self-inflation may be caused by an open cell foam inside of the bladder 210 or by a semi-rigid framework coupled to the bladder 210.

The motor 220 may be mounted to the support base 200. A shaft of the motor 220 may be directly or indirectly coupled to the compression plate 222. The motor 220 may convert electrical energy into mechanical energy. The motor 220 may cause upward or downward motion of the compression plate 222 when the electrical energy is applied to the motor 220. The electrical energy applied to the motor 220 may be controlled by the controller 230. The motor 220 may press the compression plate 222 down against the bladder 210 when the electrical energy has a first electrical polarity. The motor 220 may lift the compression plate 222 away from the bladder 210 when the electrical energy has a second electrical polarity. The motor 220 may be a rotary motor or a linear actuator.

Downward movement of the compression plate 222 may compress the bladder 210 and may increase air pressure within the bladder 210. Upward movement of the compression plate 222 may decrease the air pressure within the bladder 210 and may permit the bladder 210 to expand and fill with air.

The valve 214 may be coupled to the support base 200 at an air aperture 246 located in the top of the support base 200. The support column 250 may couple to the support base 200 above the valve 214. The valve 214 may prevent air from escaping the bladder 210 when the valve 214 in a CLOSED position. The valve 214 may permit air to escape from the bladder 210 when the valve 214 in an OPEN position. The bladder aperture 212 of the bladder 210 may be coupled to the valve 214. When the controller 230 moves the valve 214 to the OPEN position, the bladder 210 may force air through the valve 214, through the air aperture 246, and into the support column 250.

The controller 230 may control the motor 220 and the valve 214. The controller 230 may move the valve 214 to the CLOSED position and may activate the motor 220 to compress the bladder 210, thus increasing the air pressure within the bladder 210. The controller 230 may receive one or more digital messages from the remote control 260 via a receiver 232. Responsive to the one or more digital messages, the controller 230 may move the valve 214 to the OPEN position thus discharging air up through the support column 250. The ball 900 may be projected upwards when air reaches the top of the support column 250. In preparation for re-use, the controller 230 may then activate the motor 220 to lift the compression plate 222 off of the bladder 210 allowing the bladder 210 to fill with air, may move the valve 214 to the CLOSED position, and may activate the motor 220 to compress the bladder 210.

The support base 200 may further comprise a battery 242. The battery 242 may comprise one or more energy-storage devices. The battery 242 may be a source of electrical energy to operate the motor 220 and the controller 230. The battery 242 may be replaceable or rechargeable. The battery 242 may be recharged through a power coupler 240 accessible on the outside of the support base 200. In some embodiments, the power coupler 240 may be operable to power the controller 230 and the motor 220 when the support base 200 is plugged into a source of power such as a wall outlet.

The support column 250 may be a telescoping tube that may support the ball 900 above the support base 200. The support column 250 may comprise a lower tube 252 and an upper tube 254. The upper tube 254 may fit inside the lower tube 252 such that friction between the outside of the upper tube 254 and the inside of the lower tube 252 holds the support column 250 at a set height. The height of the support column 250 may be adjusted by pushing or pulling the upper tube 254 longitudinally relative to the lower tube 252. In some embodiments, the support column 250 may establish and hold the height by having the upper tube 254 screw into the lower tube 252, by comprising a spring loaded lock button in the lower tube 252 and lock aperture in the upper tube 254, or by utilizing other height adjusting mechanisms.

The upper end of the support column 250 may comprise the directional cover 256. The directional cover 256 may be a nozzle that is operable to support the ball 900. When air is discharged through the support column 250, air may project the ball 900 off of the directional cover 256. The directional cover 256 may be operable to pivot to the left and to the right such that the ball 900 may be directed towards third base 294 or towards first base 292.

The remote control 260 may comprise a plurality of operator controls 262. The remote control 260 may be a battery-operated portable transmitter that is operable to send the one or more digital messages to the receiver 232 via a wireless signal 290. The plurality of operator controls 262 may determine which of the one or more digital messages are sent to the receiver 232. The one or more digital messages may determine when the ball 900 is projected upwards and may select the air pressured used to project the ball 900.

In use, the support base 200 is placed on the home plate such that the edges of the support base 200 align with the edges of the home plate and the support column 250 extends upward. The height of the support column 250 may be adjusted to be appropriate for the height of a batter. The ball 900 may be placed on top of the directional cover 256 at the top of the support column 250 and the directional cover 256 may be adjusted to pivot towards third base 294 or towards first base 292 if desired in order to simulate inside and outside pitches. The controller 230 may open the valve 214 and may move the compression plate 222 upwards to draw air into the bladder 210. The controller 230 may then close the valve 214 and move the compression plate 222 downwards to compress the bladder 210, thus pressurizing air in the bladder 210. The coach may use the remote control 260 to determine how much compression is applied and, therefore, how high the ball 900 will project when the valve 214 is opened. With the batter in place at the home plate, the coach may use the remote control 260 to open the valve 214. Air being expelled from the bladder 210 may rush up the support column 250 and push the ball 900 up from underneath. The batter may swing at the ball 900 while the ball 900 is suspended in air above the invention 100 in order to practice batting swings.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "airtight" may refer to a container or seal that is impermeable to air.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used herein, the word "desired" may refer to a specific value or action within a range of supported values or action. A "desired" value or action may indicate that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used herein, "home plate" may refer to one of four bases used in the games of baseball, softball, or T-ball. Home plate is generally a five-sided slab set at ground level where the batter stands to receive pitches. Home plate is the final base that runners must reach in order to score a point.

As used herein, a "linear actuator" may be a device that produces linear motion. The device may be electromechanical, hydraulic, or pneumatic in nature. Upon activation by an electrical potential or by a change in fluid or air pressure, the overall length of the device may change—either by lengthening or shortening. In use, a first component of the linear actuator, which may be referred to as a motor or body, is fixed mounted to a first object and a second component of the linear actuator, which may be referred to as an actuator arm or lead screw, is fixed mounted to a second object. Activation of the device may cause the second component to linearly move relative to the first component thus changing the distance between the first object and the second object.

As used herein, the word "longitudinal" or "longitudinally" may refer to a lengthwise or longest direction.

As used in this disclosure, a "motor" may refer to a device that transforms energy from an external power source into mechanical energy.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, the word "portable" may refer to a device that may be carried by a single person and may be used at multiple locations. In some cases, portable may imply that the device may be used while being carried.

As used in this disclosure, "telescopic", "telescoping", and "telescopically" may refer to an object made of sections that fit or slide into each other such that the object can be made longer or shorter by adjusting the relative positions of the sections.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

As used in this disclosure, "vertical" may refer to a direction that is parallel to the local force of gravity. Unless specifically noted in this disclosure, the vertical direction is always perpendicular to horizontal.

As used in this disclosure, "wireless" may be an adjective that is used to describe a communication channel that does not require the use of physical cabling.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A ball-projecting batting tee comprising:

a support base, a support column, and a remote control;

wherein the ball-projecting batting tee is a batting practice aid that is placed on top of home plate and pneumatically projects a ball upwards from the top of the support column to simulate a pitch;

wherein the ball-projecting batting tee is adapted to project the ball upwards under the control of a coach using the remote control;

wherein a directional cover located at the top of the support column pivots to direct the ball towards first base or towards third base;

wherein the support base comprises a bladder, a motor, a compression plate, a valve, and a controller;

wherein the support base is a pentagonal shape when viewed from above in order to match the shape of the home plate;

wherein the support base is placed onto the home plate such that the edges of the support base align with the edges of the home plate.

2. The ball-projecting batting tee according to claim 1 wherein the bottom of the support column couples to the center of the support base such that the support column rises vertically from the support base.

3. The ball-projecting batting tee according to claim 2 wherein the bladder is a flexible, airtight sack for holding air;

wherein the bladder comprises a bladder aperture which is the only opening in the bladder.

4. The ball-projecting batting tee according to claim 3 wherein air within the bladder is forced out of the bladder via the bladder aperture when the bladder is compressed;

wherein air outside of the bladder is drawn into the bladder via the bladder aperture when the bladder is expanded.

5. The ball-projecting batting tee according to claim 4 wherein the bladder is compressed by pressure applied to the top of the bladder by the compression plate.

6. The ball-projecting batting tee according to claim 5 wherein the bladder is self-inflating.

7. The ball-projecting batting tee according to claim 5 wherein the motor is mounted to the support base;

wherein a shaft of the motor is directly or indirectly coupled to the compression plate;

wherein the motor converts electrical energy into mechanical energy;

wherein the motor causes upward or downward motion of the compression plate when the electrical energy is applied to the motor;

wherein the electrical energy applied to the motor is controlled by the controller.

8. The ball-projecting batting tee according to claim 7 wherein the motor presses the compression plate down against the bladder when the electrical energy has a first electrical polarity;

wherein the motor lifts the compression plate away from the bladder when the electrical energy has a second electrical polarity;

wherein the motor is a rotary motor or a linear actuator.

9. The ball-projecting batting tee according to claim 8 wherein downward movement of the compression plate compresses the bladder and increases air pressure within the bladder;

wherein upward movement of the compression plate decreases the air pressure within the bladder and permits the bladder to expand and fill with air.

10. The ball-projecting batting tee according to claim 9 wherein the valve is coupled to the support base at an air aperture located in the top of the support base;

wherein the support column couples to the support base above the valve;

wherein the valve prevents air from escaping the bladder when the valve in a CLOSED position;

wherein the valve permits air to escape from the bladder when the valve in an OPEN position.

11. The ball-projecting batting tee according to claim 10 wherein the bladder aperture of the bladder is coupled to the valve;

wherein when the controller moves the valve to the OPEN position, the bladder forces air through the valve, through the air aperture, and into the support column.

12. The ball-projecting batting tee according to claim 11 wherein the controller controls the motor and the valve;

wherein the controller moves the valve to the CLOSED position and activates the motor to compress the bladder, thus increasing the air pressure within the bladder;

wherein the controller receives one or more digital messages from the remote control via a receiver;

wherein responsive to the one or more digital messages, the controller moves the valve to the OPEN position thus discharging air up through the support column;

wherein the ball is projected upwards when air reaches the top of the support column;

wherein in preparation for re-use, the controller activates the motor to lift the compression plate off of the bladder allowing the bladder to fill with air, moves the valve to the CLOSED position, and activates the motor to compress the bladder.

13. The ball-projecting batting tee according to claim 12 wherein the support base further comprises a battery;

wherein the battery comprises one or more energy-storage devices;

wherein the battery is a source of electrical energy to operate the motor and the controller;

wherein the battery is replaceable or rechargeable;

wherein the battery is recharged through a power coupler accessible on the outside of the support base.

14. The ball-projecting batting tee according to claim 13 wherein the power coupler is operable to power the controller and the motor when the support base is plugged into a source of power.

15. The ball-projecting batting tee according to claim 14 wherein the support column is a telescoping tube that supports the ball above the support base;

wherein the support column comprises a lower tube and an upper tube;

wherein the upper tube fits inside the lower tube such that friction between the outside of the upper tube and the inside of the lower tube holds the support column at a set height;

wherein the height of the support column is adjusted by pushing or pulling the upper tube longitudinally relative to the lower tube.

16. The ball-projecting batting tee according to claim 15 wherein the upper end of the support column comprises the directional cover;

wherein the directional cover is a nozzle that is operable to support the ball;

wherein when air is discharged through the support column, air projects the ball off of the directional cover.

17. The ball-projecting batting tee according to claim 16 wherein the directional cover is operable to pivot to the left and to the right such that the ball is directed towards third base or towards first base.

18. The ball-projecting batting tee according to claim 17 wherein the remote control comprises a plurality of operator controls;

wherein the remote control is a battery-operated portable transmitter that is operable to send the one or more digital messages to the receiver via a wireless signal;

wherein the plurality of operator controls determine which of the one or more digital messages are sent to the receiver;

wherein the one or more digital messages determine when the ball is projected upwards and select the air pressured used to project the ball.

* * * * *